United States Patent [19]

Yoshioka et al.

[11] Patent Number: 4,967,117

[45] Date of Patent: Oct. 30, 1990

[54] ENCAPSULATED ELECTROLUMINESCENCE DEVICE

[75] Inventors: Kenji Yoshioka; Yasuichi Ono, both of Miyagi, Japan

[73] Assignee: Alps Electric Co., Ltd., Tokyo, Japan

[21] Appl. No.: 311,929

[22] Filed: Feb. 16, 1989

[30] Foreign Application Priority Data

May 23, 1988 [JP] Japan ..... 63-66787

[51] Int. Cl.[5] ..... H05B 33/04; H05B 33/06

[52] U.S. Cl. ..... 313/506; 313/512; 350/345

[58] Field of Search ..... 313/512, 511, 506; 350/345

[56] References Cited

U.S. PATENT DOCUMENTS 3,509,401 4/1970 Calley, Jr. et al. .
3,514,825 6/1970 Vodicka .
4,721,883 1/1988 Jacobs et al. ..... 313/511 X

FOREIGN PATENT DOCUMENTS 3531736 3/1986 Fed. Rep. of Germany ..... 350/345
3541950 6/1986 Fed. Rep. of Germany ..... 313/512

*Primary Examiner*—Palmer C. DeMeo
*Attorney, Agent, or Firm*—Guy W. Shoup; Paul J. Winters

[57] ABSTRACT

An electroluminescence device having an excellent moisture-resistant property is disclosed. Such an electroluminescence device comprises a light emitting layer inserted between an opposite electrode and a transparent electrode to form a multi-layered structure, said structure being airtightly sealed by a pair of protective sheets and said ELD being able to be fitted to an external apparatus by means of a metal fixture. The ELD is characterized in that a metal composite film is formed by inserting a metal foil between a pair of resin films and is used for one of the protective sheets for said opposite electrode. The composite film having a notch which is formed by removing part of the metal foil around a portion of the metal composite film prepared to accommodate the metal fixture.

5 Claims, 2 Drawing Sheets

ENCAPSULATED ELECTROLUMINESCENCE DEVICE

BACKGROUND OF THE INVENTION

The present invention relates an electroluminescence device and more particularly to an electroluminescence device using a highly moisture-resistant metal composite film as protective sheet for the opposite electrode.

The technological advancement in the field of electroluminescence devices (hereinafter referred to as ELDs) in recent years has made it possible to produce ELDs with relatively high luminosity and hence broadened the scope of application. Particularly, ELDs of dispersion type are attracting attention of interested parties as they have a wide variety of applications because of low cost, high luminosity and other advantages.

FIG. 3 of the accompanying drawings illustrates a sectional view of a conventional ELD and FIG. 4 is a partial enlarged view thereof, where reference numeral 1 denotes a transparent sheet, 2 a transparent electrode formed under said sheet 1 in the sense of the drawings, 3 a light emitting layer made of a phosphor-coated material and a dielectric material, 4 an opposite electrode made of a foil of metal such as aluminum, 5 a moisture absorbing layer having a highly hygroscopic property, 6 and 7 are protective sheets for protection of said transparent sheet 1, transparent electrode 2, light emitting layer 3, opposite electrode 4 moisture absorbing layer 5. Each of said transparent electrode 2 and opposite electrode 4 is provided with a lead terminal which is not shown in the drawings so that they can be electrically connected with an external power source and said light emitting layer 3 emits light when voltage is applied thereto.

Such a conventional ELD is normally sealed airtight by a pair of protective sheets 6 and 7, since if it is used in a moist environment, it can be degraded to significantly lose its luminosity and hence its durability as the phosphorcoated material in the ELD is decomposed quickly in such a moist environment. A synthetic resin film of ethylene trifluoride chloride or polyethylene is typically used for the protective sheet 6 of the transparent electrode, while a highly moisture-resistant metal composite film made of a pair of resin films 8, 8 of a material such as polyethylene terephtalate and a laminated metal 9 inserted therebetween is typically used as the protective sheet 7 for the opposite electrode 4. The peripheries of the two protective sheets 6 and 7 are bonded together by means of heat seal using a hot melt.

An ELD having a configuration as described above is typically used for a back light in a liquid crystal display apparatus. As shown in FIG. 5, ELD 20 is fitted to the back of the casing 22 incorporating a liquid crystal display 21 by utilizing a fixture 23 of the casing 22 and then the casing 22 is rigidly mounted on a wiring circuit substrate 24, while said liquid display 21 and ELD 20 are electrically connected with a drive circuit in said wiring circuit substrate 24 so that the light emitted from the light emitting layer 3 of the ELD 20 functions as a back light of the liquid crystal display 21 of a transmission type. Reference numeral 10 in FIG. 5 denotes a lead terminal for an external source to be connected with the ELD 20 and numeral 11 denotes a fitting bore to accommodate the fixture 23.

While a conventional ELD as described above and using a metal composite film 7 as a protection sheet for the opposite electrode 4 can be highly moisture-resistant because of the use of a metal laminate 9, it requires some electric insulating measures because it can undesirably affect circuits external to the ELD as the periphery of the metal foil 9 is exposed to the atmosphere and therefore can become electrically active. Referring to FIG. 5, if the casing 22 is made of a metal sheet with a view of giving it a function of grounding, noises picked up by the metal foil 9 can proceed to the grounding to interfere with the normal operation of the drive circuit because the metal foil 9 is connected with the metal fixture 23 within the fitting bore 11.

It is therefore an object of the present utility design to provide an ELD which uses a metal composite film for the protective sheet but effectively eliminates adverse effects of the metal film to external circuits.

SUMMARY OF THE INVENTION

According to the present invention the above object is achieved by providing an ELD comprising a light emitting layer inserted between an opposite electrode and a transparent electrode to form a multi-layered structure, said structure being airtightly sealed by a pair of protective sheets and said ELD being able to be fitted to an external apparatus by means of a metal fixture, wherein a metal composite film formed by inserting a metal foil between a pair of resin films is used for said protective sheet for said opposite electrode, said metal composite film having a notch formed by removing part of said foil around a portion of metal composite film prepared to accommodate said fixture.

Since an ELD according to the present invention as described above has a notch formed by removing part of the metal foil at a predetermined position so that the fixture for the ELD can pass through the notch or the area surrounded by the notch, the fixture does not come into contact with the metal foil of the metal composite film. It contacts only a portion of the metal foil which is electrically isolated by the notch.

Now the present invention will be described in greater detail by referring to the accompanying drawings which illustrate embodiments of the ELD according to the present invention.

DETAILED DESCRIPTION OF THE INVENTION

Figure 1:
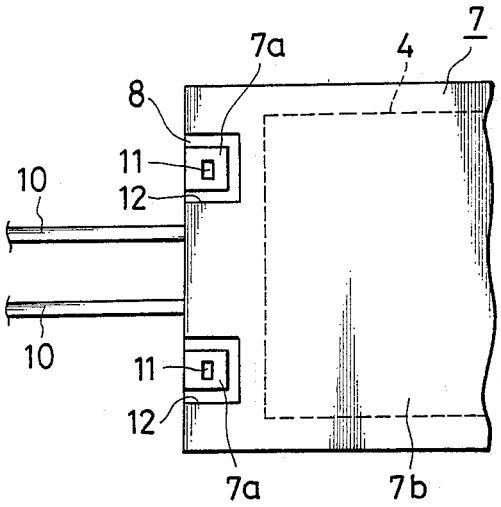
FIG. 1 is a bottom view illustrating a principal area of an embodiment of the electroluminescence device according to the present invention.
Figure 3:
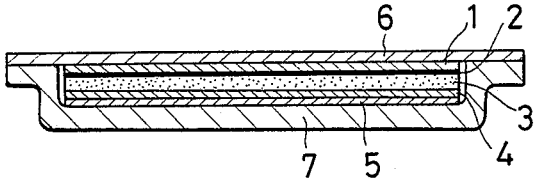
FIG. 3 (PRIOR ART)
FIG. 3 is a sectional view illustrating a conventional electroluminescence device.
Figure 4:
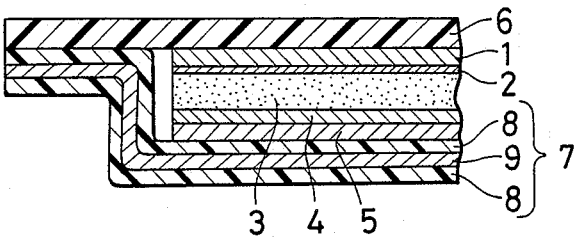
FIG. 4 (PRIOR ART)
FIG. 4 is a partial enlarged view of the device of FIG. 4.
Figure 5:
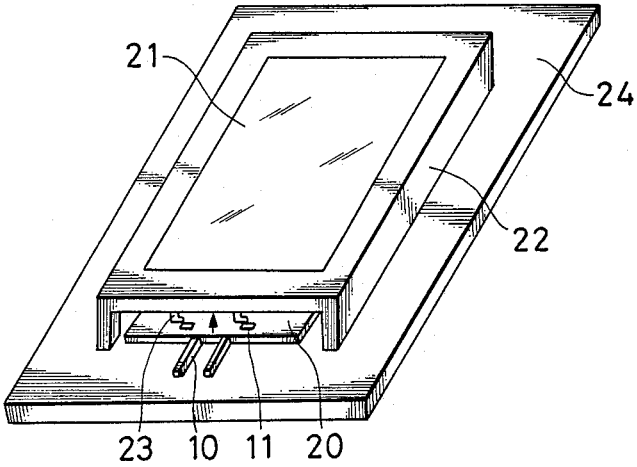
FIG. 5 is a view illustrating operation of an electroluminescence device.

Now, referring to FIG. 1 which shows a bottom view of an embodiment of the ELD according to the present invention, the components which are silimar to those of the ELD shown in FIGS. 3, 4 and 5 are indicated by identical reference numerals and will not be described any further.

This embodiment differs from the above described conventional ELD in that a substantially square notch 12 is provided surrounding an area *7a* on the periphery of a metal composite film 7, said area *7a* comprising a fitting bore 11 for accommodating a fixture. More specifically, the metal composite film 7 used as a protective sheet for opposite electrode 4 has a three-layer structure comprising a metal laminate inserted between a pair of resin films with an appropriate portion of two of the three constituting layers cut-out from the notch 12 in such a manner that the portion *7a* comprising the fitting bore 11 and the portion *7b* of the film 7 are mutually electrically insulated. The notch 12 can be formed by half-cutting the relevant area of two of the three constituting layers of the protective sheet, including the metal foil layer after inserting a metal foil between a pair of resin films. Alternatively the relevant area of the metal foil may be press-cut before it is inserted between a pair of resin films.

With an ELD having such an arrangement, if a metal fixture is inserted into the fitting bore 11 to fit the ELD to an external apparatus, the fixture contacts only the metal foil located within the electrically isolated area *7a*. The mutually electrically insulated condition of the metal foil area *7b* from area *7a* and the metal fixture is maintained.

Therefore, any possibility for the metal composite film 7 to adversely affect external circuits by way of the metal fixture is eliminated.

Figure 2:
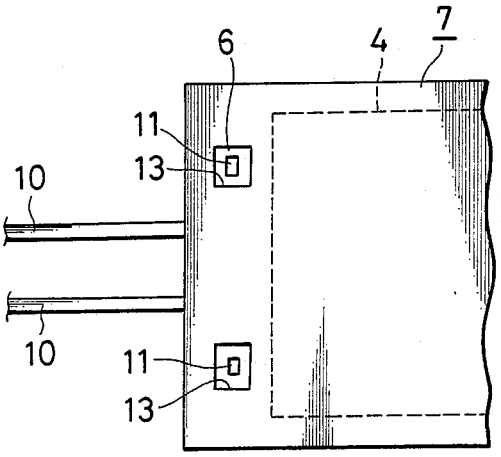
FIG. 2 is a bottom view illustrating a principal area of another embodiment of the electroluminescence device according to the present invention.

FIG. 2 illustrates another embodiment of the ELD according to the present invention.

This embodiment differs from the first embodiment in that notch 13 is formed by press-cutting a portion of metal composite film 7 and a portion of transparent resin film 6 for protection of the opposite electrode and a portion of the fitting bore 11 is exposed to said notch 13.

With such an arrangement, even if a metal fixture is brought into the fitting bore 11, it does not contact the metal composite film 7 so that there will not be any possibility for the metal foil of the metal composite film 7 to adversely affect the external circuit. It should be noted that while the fixture anchors only the transparent resin film 6 and does not directly hold the metal composite film 7 in position, the ELD will be fitted to its proper position without trouble because the periphery of the metal composite film 7 is closely contacted with the transparent resin film 6.

As is apparent from the above description, a ELD according to the present invention comprises a notch formed around the area where the fixture for anchoring the ELD is inserted and the metal foil is cleared away. Hence, the metal foil of the metal composite film is free from any risk of adversely affecting circuit external to the ELD by way of said fixture. Therefore, a metal composite film having an excellent moisture-resistant property can be supplied at low cost for the protection of the opposite electrode without adverse effects.

What is claimed is:

1. An electroluminescence device (ELD) comprising a light emitting layer inserted between an opposite electrode and a transparent electrode to form a multi-layered structure, said structure being airtightly sealed by a pair of protective sheets and said ELD being able to be fitted to an external apparatus by means of a metal fixture, wherein a metal composite film formed by inserting a metal foil between a pair of resin films s used for a first sheet of said pair of protective sheets over said opposite electrode, said metal composite film having a notch formed by removing part of said metal foil around a portion of said metal composite film prepared to accommodate said fixture, said notch being located near an edge of said metal composite film.

2. An electroluminescence device according to claim 1, wherein one of the pair of resin films and said metal foil of said metal composite film over said opposite electrode are half-cut to form the notch.

3. An electroluminescence device according to claim 1, wherein the notch is formed by press-cutting said portion of said metal composite film and a second sheet of said pair of protective sheets, said second sheet for protecting the transparent electrode, the notch including a bore for accommodating said metal fixture.

4. An electroluminescence device according to claim 2 wherein the periphery of said metal composite film is rigidly bonded to the pair of resin films.

5. An electroluminescence device according to claim 3 wherein the periphery of said metal composite film is rigidly bonded to said second sheet of said pair of protective sheets.

* * * * *